US008410998B2

(12) United States Patent
Bezal et al.

(10) Patent No.: US 8,410,998 B2
(45) Date of Patent: Apr. 2, 2013

(54) DEVICE FOR DRIVING A PLASMA DISPLAY PANEL

(75) Inventors: Jean-Raphael Bezal, Meylan (FR); Gérard Rilly, Saint Etienne Crossey (FR); Philippe Zorzan, Grenoble (FR)

(73) Assignee: Thomson Licensing, Boulogne-Billancourt (FR)

( * ) Notice: Subject to any disclaimer, the term of this patent is extended or adjusted under 35 U.S.C. 154(b) by 1506 days.

(21) Appl. No.: 10/572,691

(22) PCT Filed: Sep. 9, 2004

(86) PCT No.: PCT/EP2004/010083
§ 371 (c)(1),
(2), (4) Date: Jan. 5, 2007

(87) PCT Pub. No.: WO2005/041161
PCT Pub. Date: May 6, 2005

(65) Prior Publication Data

US 2007/0195015 A1 Aug. 23, 2007

(30) Foreign Application Priority Data

Oct. 1, 2003 (FR) ..... 03 11479

(51) Int. Cl.
*G09G 3/28* (2006.01)

(52) U.S. Cl. ..... 345/66; 345/68

(58) Field of Classification Search ..... 345/60, 345/66–68; 315/169.1
See application file for complete search history.

(56) References Cited

U.S. PATENT DOCUMENTS

| | | | | |
|---|---|---|---|---|
| 395,966 | A | 5/1976 | Peters | |
| 6,369,514 | B2 * | 4/2002 | Awamoto | 315/169.1 |
| 6,400,343 | B1 | 6/2002 | Zorzan et al. | |
| 6,917,351 | B1 * | 7/2005 | Velayudhan et al. | 345/60 |

FOREIGN PATENT DOCUMENTS

| | | | |
|---|---|---|---|
| EP | 0549275 | | 6/1993 |
| EP | 1018722 | | 7/2000 |
| EP | 1030286 | | 8/2000 |
| JP | 2001-228821 | * | 8/2001 |
| JP | 2001228821 | A | 8/2001 |

OTHER PUBLICATIONS

Search Report Dated Jun. 30, 2005.

* cited by examiner

*Primary Examiner* — Yong H Sim
(74) *Attorney, Agent, or Firm* — Robert D. Shedd; Sammy S. Henig

(57) ABSTRACT

The present invention relates to a device for driving a plasma display panel having a plurality of cells arranged in rows and columns, said device comprising row address means for selectively addressing the display cell rows and creating, where required, in cooperation with means for selectively applying data voltages to the display columns, an electrical discharge inside the cell disposed at the intersection of the row and column selected during an address phase, and sustain means (I3, I4, I5, I6) for sustaining the electrical discharges inside said cell during a sustain phase immediately following the address phase. According to the invention, the row address means and/or the sustain means are capable of allowing a bi-directional current to flow in the display cells during the address and/or sustain phases. The capacitive and light-emission currents appearing during these phases can thus flow freely and do not create electromagnetic interference.

9 Claims, 13 Drawing Sheets

DEVICE FOR DRIVING A PLASMA DISPLAY PANEL

This application claims the benefit, under 35 U.S.C. §365 of International Application PCT/EP04/010083, filed Sep. 9, 2004, which was published in accordance with PCT Article 21(2) on May 6, 2005 in English and which claims the benefit of French patent application No. 03/11479, filed Oct. 1, 2003.

The present invention relates to a device for driving a plasma display panel having a plurality of cells arranged in rows and columns, said device comprising row address means for selectively addressing the display cell rows and creating, where required, in cooperation with means for selectively applying data voltages to the display columns, an electrical discharge inside the cell disposed at the intersection of the row and column selected during an address phase, and sustain means for sustaining the electrical discharges inside said cell during a sustain phase immediately following the address phase.

Currently, there exist various types of AC plasma display panel (hereafter referred to as PDP): those that use only two intersecting electrodes to define a cell, such as is described in the French Patent FR 2 417 848, and those of the "coplanar sustain" type, known notably from the European Patent document EP-A-0 135 382, in which each cell is defined at the intersection of a pair of electrodes, known as "sustain electrodes", and one or more other electrodes, known as column electrodes, used especially for cell addressing. The present invention will be described more particularly in relation to an AC PDP of the coplanar sustain type without however implying any particular limitation to this type of display.

The operation and the structure of an AC PDP with coplanar sustain is explained below with reference to FIG. 1. The display 1 comprises column electrodes $X_1$ to $X_4$ which are orthogonal to pairs $P_1$ to $P_4$ of sustain electrodes. Each intersection of a column electrode $X_1$ to $X_4$ with a pair of sustain electrodes $P_1$ to $P_4$ defines a cell $C_1$ to $C_{16}$ which corresponds to an elementary point of the image, conventionally called pixel. In this non-limiting example in FIG. 1, only 4 column electrodes $X_1$ to $X_4$ and only 4 pairs of sustain electrodes $P_1$ to $P_4$, which together form 4 rows $R_1$ to $R_4$, are shown. However, the display, of course, generally comprises many more of these electrodes.

The column electrodes $X_1$ to $X_4$ are generally only used for addressing. They are each connected in a conventional manner to a column driver device 2.

The electrode pairs $P_1$ to $P_4$ each comprise an electrode known as the address-sustain electrode $Yas_1$ to $Yas_4$ and an electrode called the sustain-only electrode $Y_1$ to $Y_4$. The address-sustain electrodes $Yas_1$ to $Yas_4$ perform an addressing function in cooperation with the column electrodes $X_1$ to $X_4$, and they perform a sustaining function in cooperation with the sustain-only electrodes $Y_1$ to $Y_4$. The sustain-only electrodes $Y_1$ to $Y_4$ are connected to each other and to a pulse generator 3 from which they all simultaneously receive periodic voltage pulses in order to perform sustain cycles.

The address-sustain electrodes $Yas_1$ to $Yas_4$ are powered separately from a row driver device 4 from which they notably receive, during a sustain phase, periodic voltage pulses in synchronization with those applied to the sustain-only electrodes $Y_1$ to $Y_4$ but with a time delay relative to the latter, and, during an address phase, base pulses in synchronization with the signals applied to the column electrodes $X_1$ to $X_4$.

Synchronization between the various signals applied to the various electrodes is provided by a synchronization device 5 connected to the devices 2 and 4 and to the generator 3.

The operation for addressing a PDP pixel consists in simultaneously applying an address signal to the address-sustain electrode of this pixel and a data signal to its column electrode. A constant potential is also applied to the sustain-only electrodes. Each row is individually addressed by applying a negative pulse to the corresponding address-sustain electrode via a row driver circuit. The columns are addressed individually and simultaneously with the addressing of each row.

The voltage signals applied to the electrodes Yas, Y and X of the PDP during the address phase and the sustain phase are shown in FIG. 2. In this figure, the PDP is considered to comprise n rows of cells. During the address phase, the cell rows of the PDP are successively addressed by the application of a negative voltage pulse to the address-sustain electrodes Yas of the corresponding rows. A potential Vbw is applied to the address-sustain electrodes of the rows not addressed and a potential Vw, lower than Vbw (for example a zero or negative potential), is applied to the address-sustain electrodes of the addressed row. In the example in FIG. 2, Vw=0. Depending on the data value to be addressed (0 or 1), a positive voltage pulse, with a value Vdata, is applied or not to the column electrodes X. This positive voltage pulse is synchronized with the negative voltage pulse applied to the address-sustain electrode. This creates an electric field within the cell situated at the intersection of the column electrode and the address-sustain electrode. Regarding the potential applied to the sustain-only electrodes Y, it is maintained at a value Vs during this phase.

During the sustain phase that follows, periodic pulses in phase opposition are applied to the sustain electrode pairs of the cells. The potential of the pulse high level is fixed at the value Vs, greater than Vbw, and that of the pulse low level is fixed at 0 volts.

A conventional row driver device 2 is described below with reference to FIG. 3. This device comprises row driver circuits 11 each controlling the potential applied to the address-sustain electrodes Yas of a block of j rows of the PDP. A control signal CTRL is used to control these driver circuits 11 and to selectively apply the potentials Vbw, Vw and Vs to the cell address-sustain electrodes. The driver circuits 11 are connected to 2 circuit lines, L1 and L2. A device, formed by a switch I1 connected in series with a diode D1 between a power supply terminal receiving the voltage Vbw and the line L1, is provided for applying the voltage Vbw to the line L1 when the switch I1 is closed. The diode D1 is oriented so as to allow a current to flow from the power supply terminal to the line L1. A second device, formed by a switch I2 connected in series with a diode D2 between a power supply terminal receiving the voltage Vw and the line L2, is provided for applying the voltage Vw to the line L2 when the switch I2 is closed. The diode D2 is oriented so as to allow a current to flow from the line L2 to the power supply terminal. A third device, formed by 2 switches, I3 and I4, and by a diode D3 connected in series between a terminal receiving the voltage Vs and ground is provided for applying voltage pulses to the line L1 during the sustain phase. The switch I3 and the diode D3 are connected between the power supply terminal for Vs and the line L1 and the switch I4 is connected between the line L1 and ground. Finally, a device 12 is inserted between the lines L1 and L2 in order to recover energy during the address and sustain phases.

The purpose of the diodes D1 and D3 is to prevent the current from flowing into the supply circuits for the voltages Vbw and Vs when a "priming" voltage, greater than the voltages VBw and Vs, is applied to the line L1 (not shown in the circuit diagram). The purpose of the priming voltage is to reset the PDP cells prior to their address phase. Similarly, the diode D2 prevents the current from flowing into the supply source for the voltage Vw when the voltage on the line L2 is lower than Vw (for example, when the cells are erased after the priming phase).

A circuit diagram of the row driver circuits 11 is shown in FIG. 4. This circuit diagram is well known to those skilled in the art and does not require a detailed description. In summary, it comprises a shift register controlled by the signal CTRL. This register controls, for each row i of cells, switches ITi and ITi' connected in series between input terminals connected to the lines L1 and L2. The row i is connected to the mid-point between the switches ITi and ITi'. In this figure, each switch consists of a transistor connected in parallel with a diode.

The operation of the driver device 2 in FIG. 3 is well known to those skilled in the art. During the address phase, the switches I1 and I2 are closed in order to respectively apply the voltage Vbw and the voltage Vw to the lines L1 and L2. The row driver circuits 11 are controlled so as to sequentially select all the rows of the PDP and, when a row is selected, to apply the voltage Vw to it and to apply the voltage Vbw to the other rows of the PDP. The switches I3 and I4 are open during this phase.

During the sustain phase, the switches I1 and I2 are open. The switches I3 and I4 are alternately closed in order to generate a pulse signal on the line L1 of the device.

Although this driver device is routinely employed, it does however present a major drawback. At each change of potential of the signal applied to the address-sustain electrode Yas, for example at the moment when a PDP row is selected, the diodes D1 and D2 prevent a capacitive current from flowing through the cell and creating overvoltages within the cell concerned. More precisely, these diodes prevent the capacitive current from freely flowing into the supply sources for the voltages Vbw and Vw. These overvoltages may then modify the behaviour of the cells, cause stresses in the components of the driver device and generate electromagnetic interference.

The invention proposes a driver device that does not present the aforementioned drawbacks.

A subject of the invention is a device for driving a plasma display panel having a plurality of cells arranged in rows and columns, the device comprising row address means for selectively addressing the display cell rows and creating, where required, in cooperation with means for selectively applying data voltages to the display columns, an electrical discharge inside the cell disposed at the intersection of the row and column selected during an address phase, and sustain means for sustaining the electrical discharges inside the cell during a sustain phase immediately following the address phase. According to the invention, the row address means and/or sustain means are capable of allowing a bi-directional current to flow within the cells of the display during the address and/or sustain phases.

The current thus flows freely within the device without creating overvoltages or electromagnetic interference.

According to a first embodiment, the row address means comprise:

at least one row driver circuit connected between first and second connection lines and designed to apply, during the address phase, the potential of one of said first and second connection lines to a first electrode of the cells of a plurality of rows, a first switch for selectively applying an address voltage to the second connection line during the address phase, a first diode connected in series with a second switch for applying a second voltage to the first connection line during the address phase, said diode being oriented so as to allow a current to flow in the direction of the first connection line, and a capacitor for connecting the cathode of the first diode to the second connection line.

In this embodiment, the sustain means comprise at least:

third and fourth switches for selectively applying a high sustain voltage and a low sustain voltage to said first connection line, fifth and sixth switches for selectively applying said high sustain voltage and said low sustain voltage to a second electrode of the cells of the plurality of rows selected by said row driver circuit, said third and sixth switches on the one hand, and said fourth and fifth transistors on the other, being controlled in an identical manner.

In a second embodiment, the cell rows are divided into a plurality of blocks of rows and separate row address means are then provided for each of the blocks of rows.

Another subject of the invention is a plasma display panel comprising the aforementioned driver device.

The invention will be better understood and further features and advantages will become apparent upon reading the following description, which refers to the appended drawings, among which:

FIG. 1, described above, is a block diagram of a plasma display panel;

FIG. 2, described above, shows the signals applied to the electrodes of the display cells in FIG. 1;

FIG. 3, described above, shows the circuit diagram of a prior art row driver device;

FIG. 4, described above, shows the circuit diagram of a conventional row driver circuit of the driver device in FIG. 3;

According to the invention, the row driver device 2 is designed to allow the capacitive current and light-emission current to flow in both directions within said device during the address and sustain phases of the PDP cells. The capacitive current represents the current flowing between the non-coplanar electrodes, namely between the address-sustain electrodes Yas and the column electrodes X of the cells, during the address and sustain phases, and the light-emission current represents the current flowing between the coplanar electrodes of the cells during the sustain phase of the latter.

Figure 5:
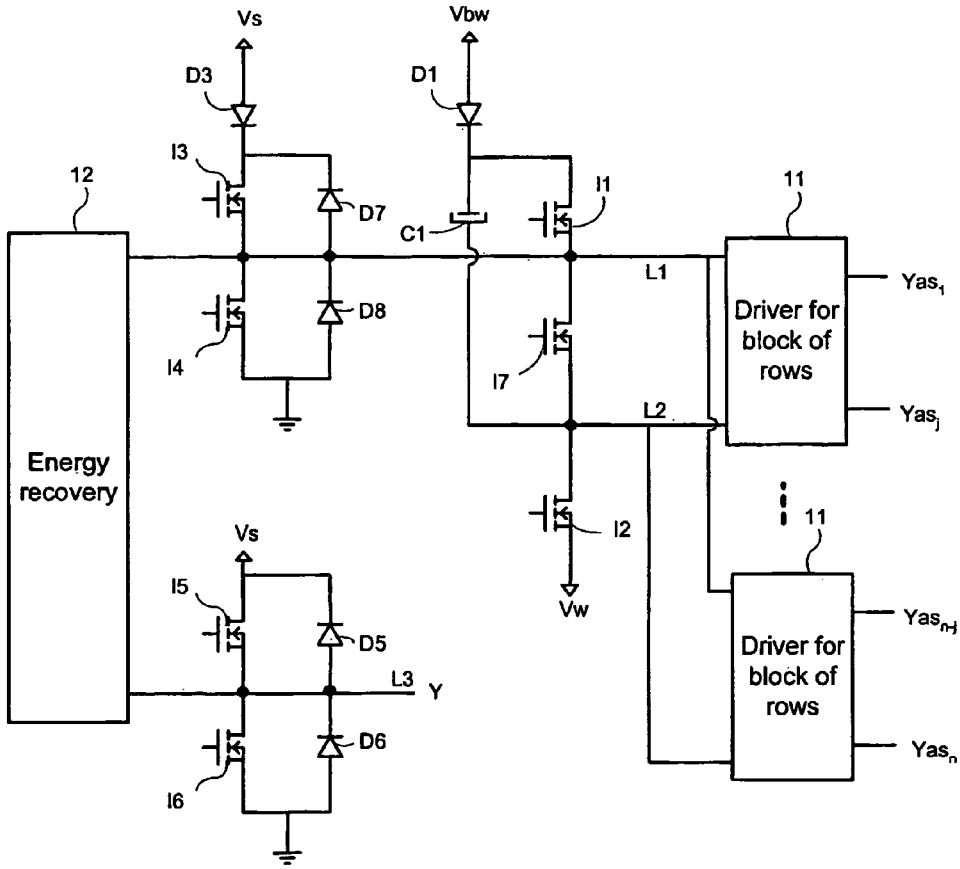
FIG. 5 shows the circuit diagram of a first row driver device according to the invention.

A first embodiment of the driver device according to the invention is proposed in FIG. 5. References identical to those used in FIG. 3 have been used for the elements providing the same functions.

Figure 3:
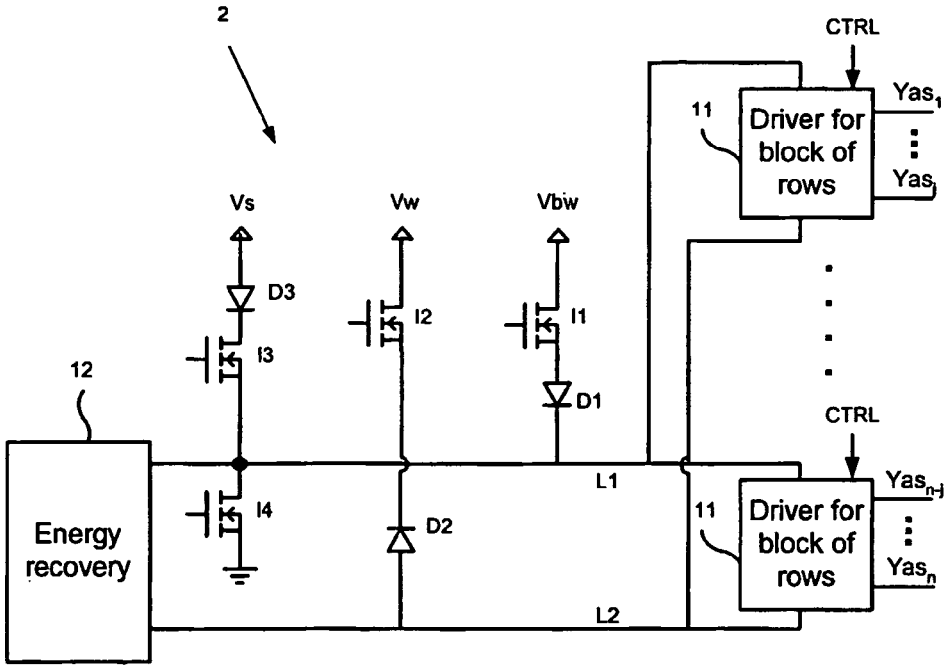
Figure 4:
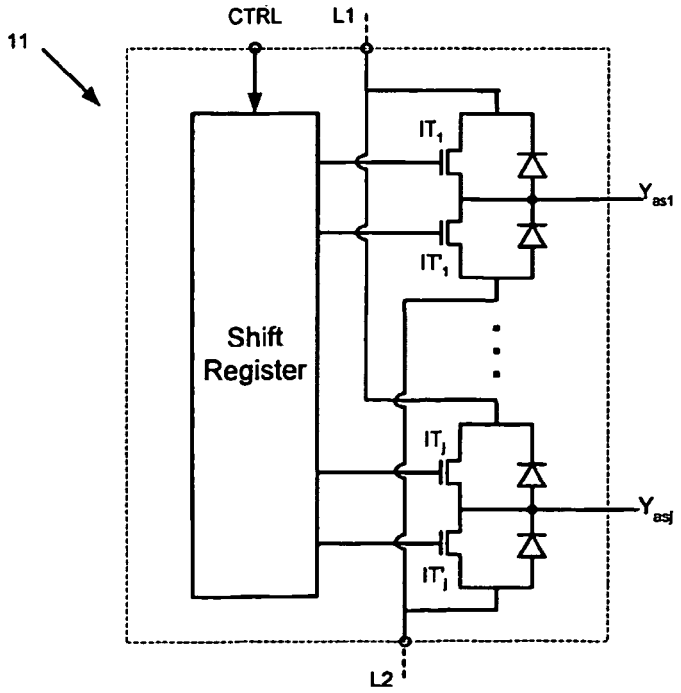

The elements I1, D1, I3, D3 and I4 are connected in the same manner as in FIG. 3 to the line L1. The switch I2 is connected directly to the line L2, without diode D2. The energy recovery device is not inserted between the lines L1 and L2 but between the line L1 and a line L3 connected to the electrodes Y of the PDP cells. The switches I5 and I6 connected in series between the supply terminal for the voltage Vs and ground are provided in order to-generate a voltage pulse on the line L3 during the sustain phase of the PDP cells. Although these two switches I5 and I6 do not appear in FIG. 3, the use of such switches in order to apply a voltage pulse to the electrodes Y of the cells is standard.

For the implementation of the invention, the device is completed by a capacitor C1 inserted between the cathode of the diode D1 and the line L2, which guarantees that a correct supply voltage is maintained, without overvoltage, across the terminals L1 and L2 of the driver circuits 11. A switch I7, which is open during the address phase of the cells and closed during the sustain phase, is also inserted between the lines L1 and L2. Lastly, the diodes D5, D6, D7 and D8 are respectively connected in parallel with the switches I5, I6, I3 and I4.

Figure 6:
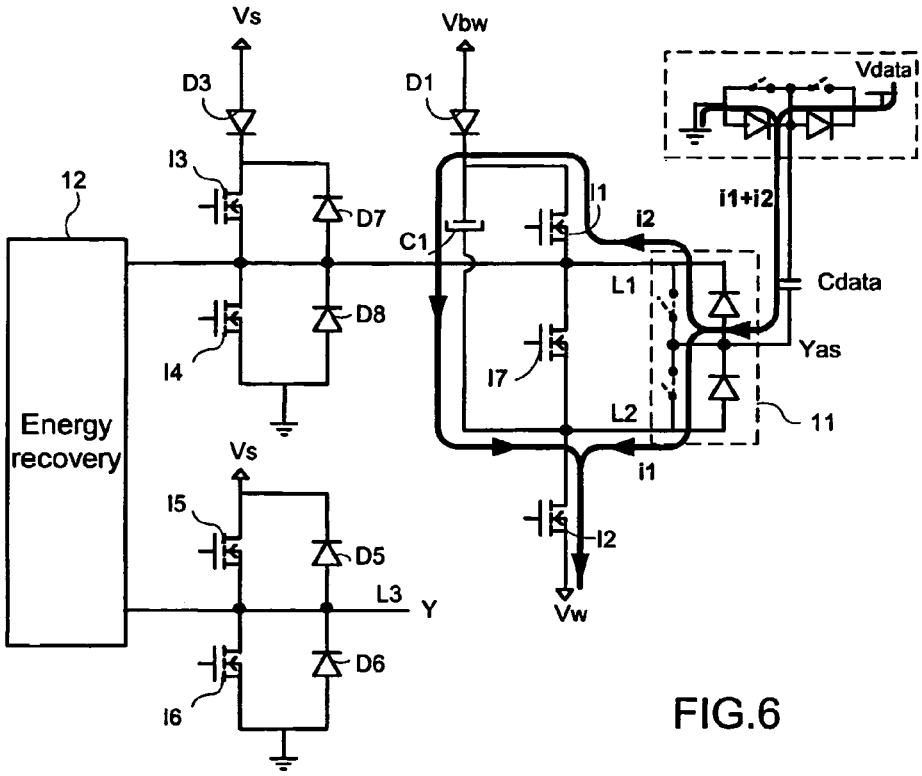
FIGS. 6 and 7 show the capacitive currents flowing in the driver device in FIG. 5 during the address phase of the PDP cells.
Figure 7:
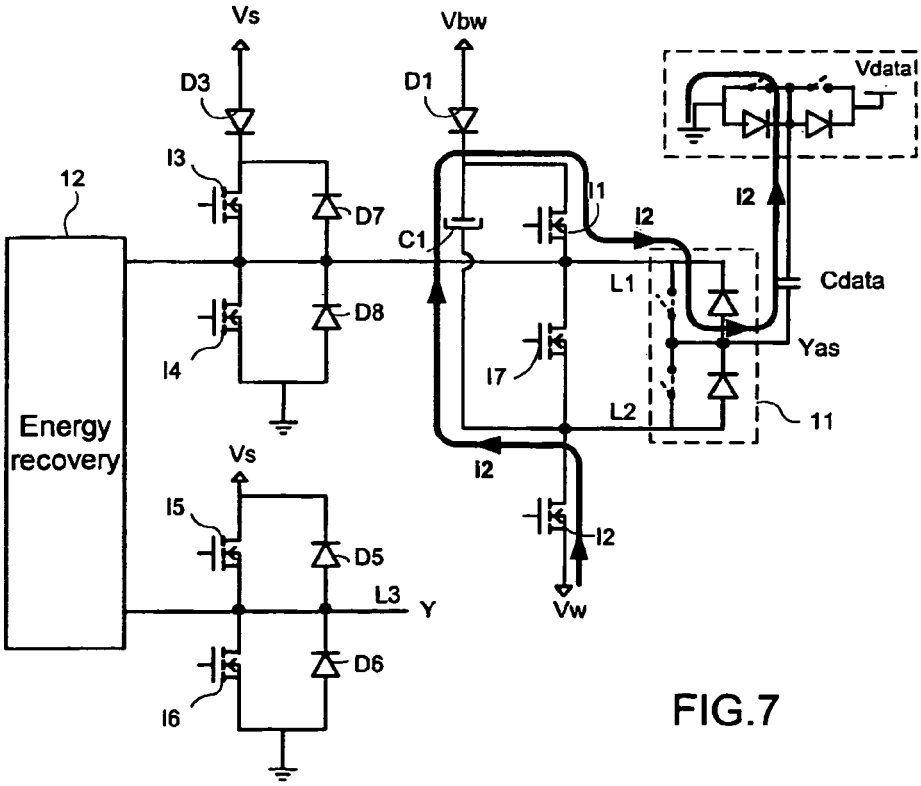

The capacitive and/or light-emission currents flowing through this driver device during the address phase and the sustain phase are shown in FIGS. 6 to 9. A simplified column driver circuit is shown in these figures in order to illustrate the total path followed by the currents. The circuit diagram of the row driver circuit 11 is simplified for the same reason. The PDP cells are represented in FIGS. 6 and 7 by their non-coplanar capacitance, denoted Cdata, (corresponding to the total capacitance of the PDP between the non-coplanar electrodes Yas and X), and in FIGS. 8 and 9 by the capacitance Cdata and their coplanar capacitance, denoted Cpap (corresponding to the total capacitance between the coplanar electrodes Yas and Y).

In FIG. 6, the capacitive current, denoted i1, represents the current flowing through the cells of the selected row, and the capacitive current, denoted i2, represents the current flowing through the cells of the other rows of the PDP. These two currents are present during the falling edge (from Vbw to Vw) of the voltage applied to the electrodes Yas of the cells of the selected row. As shown in the figure, the current i1 flows through the column driver circuit, the cells of the addressed row, the row driver circuit 11 and the switch I2 in order to reach the supply source of the voltage Vw. As regards the current i2, this flows through the column driver circuit, the cells of the other rows, the row driver circuit 11, the switch I1, the capacitor C1 and the switch I2 in order to reach the supply source of the voltage Vw.

During the rising edge of the voltage signal (from Vw to Vbw) on the electrodes Yas of the cells of the selected row, the current i1 does not exist and the current i2 flows in the opposite direction, as shown in FIG. 7. The currents flowing through the driver device during the cell sustain phase are shown in FIGS. 8 and 9.

Figure 8:
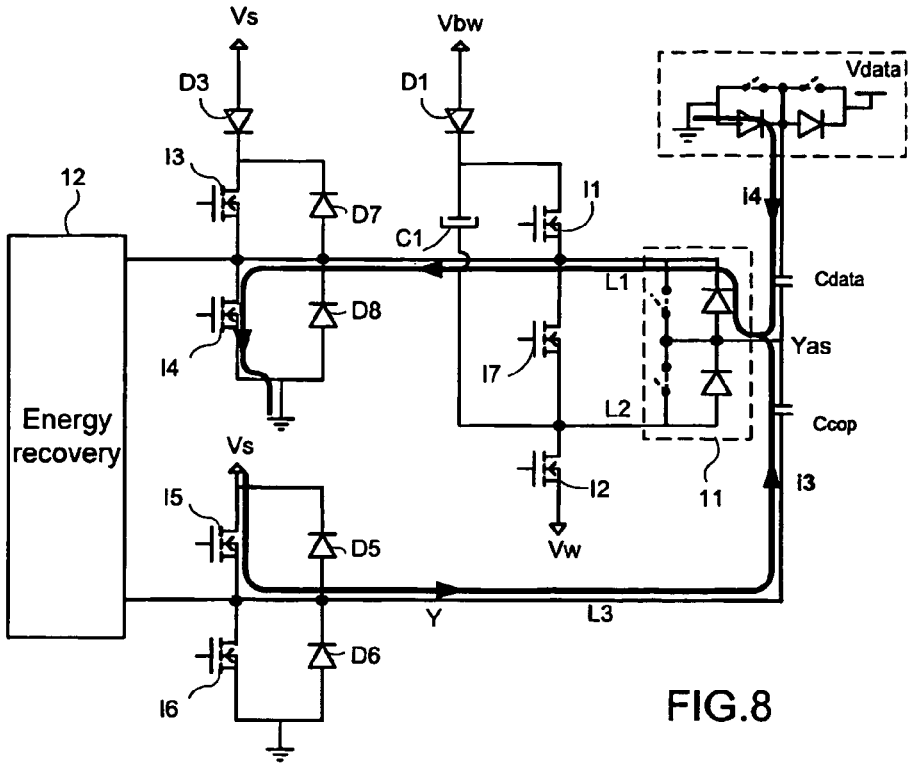
FIGS. 8 and 9 show the capacitive and light-emission currents flowing in the driver device in FIG. 5 during the sustain phase of the PDP cells.

The currents flowing through the device during the rising edge on the electrode Y of the PDP cells (corresponding to the falling edge on the electrode Yas) are shown in FIG. 8. A current denoted i3 originating from the source of the voltage Vs flows through the switch I5, the row driver circuit 11 and the switch I4 in order to reach ground. A current i4 originating in the column driver also flows through the row driver circuit 11 and the switch I4 in order to reach ground.

Figure 9:
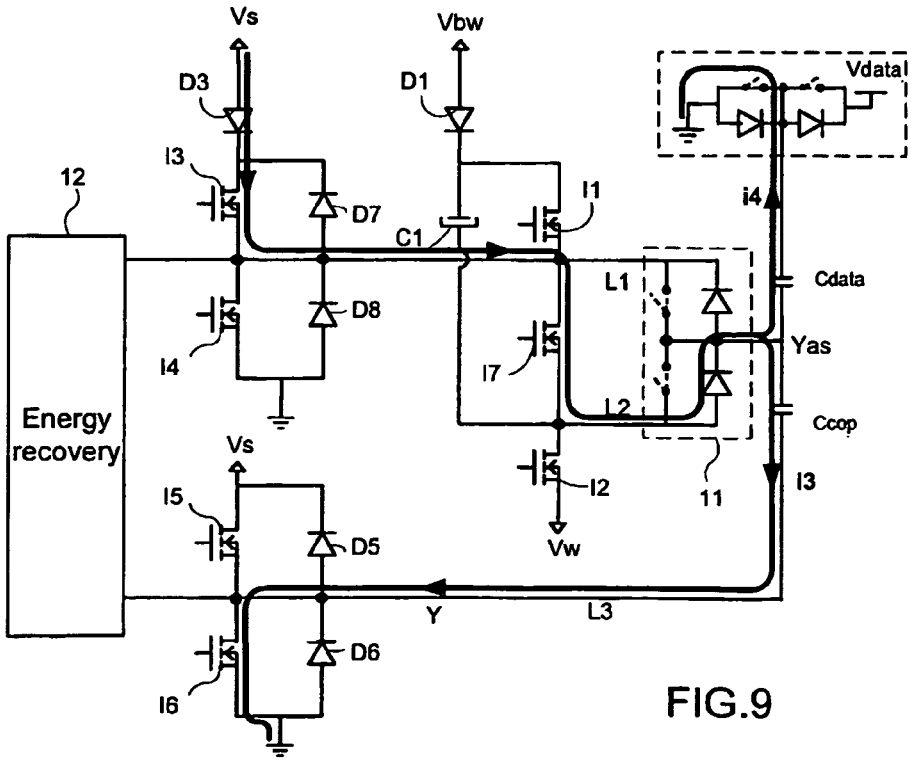

During the falling edge on the cell electrode Y (corresponding to the rising edge on the electrode Yas), the currents i3 and i4 flow in the opposite direction, as shown in FIG. 9. The current paths are somewhat modified with respect to those shown in FIG. 8. The current i3 notably flows through the row driver circuit via another diode and flows through the switch I7.

According to these figures, it can be seen that the currents can flow in both directions through the driver device during the address and sustain phases. The voltage levels are thus attained more rapidly and the level of interference, in particular electromagnetic, is reduced.

Furthermore, it is known from the Fujitsu document EP 1 172 788 that addressing the PDP cell rows in blocks improves the temperature behaviour of the operation of the driver device. The rows of the PDP are, for example, divided into 2 blocks, B1 and B2, each of these blocks of rows being controlled by a plurality of row driver circuits 11. This particular method of addressing uses the application of the voltage Vw to a row of cells to be selected belonging, for example, to the block B1 and a voltage Vbw1, equal to the previously defined voltage Vbw, to the other rows of the block B1 whereas a voltage Vbw2, higher than Vbw1, is applied to the rows of the block B2.

The device of the invention can be adapted to implement this addressing mode. One embodiment is proposed in FIG. 10. In this example, the block B1 comprises the first n/2 rows of the PDP and the block B2 comprises the following n/2 rows. In this device, specific address means are provided for each of the blocks. The elements I1, D1, C1 and I2, configured as in FIG. 5, are used for addressing the rows of the block B1. The lines L1 and L2 are dedicated to the block B1. The line L1 is connected to the rest of the driver device, namely to a line L4, via a switch I10. This line L4 is then connected to the mid-point of the switches I3 and I4 via the switch I10. Elements I1', D1', C1' and I2', identical to the elements I1, D1, C1 and I2, configured in the same way and providing the same functions, are used to address the rows of the block B2. Lines L1' and L2', identical to the lines L1 and L2, are allocated to the block B2. The line L1' is connected to the line L4 via a switch I10'.

For the cell sustain, a switch having the same function as the switch I7 in FIG. 5 is provided for each of the blocks. The switches are respectively denoted I7 and I7' in the blocks B1 and B2.

Figure 10:
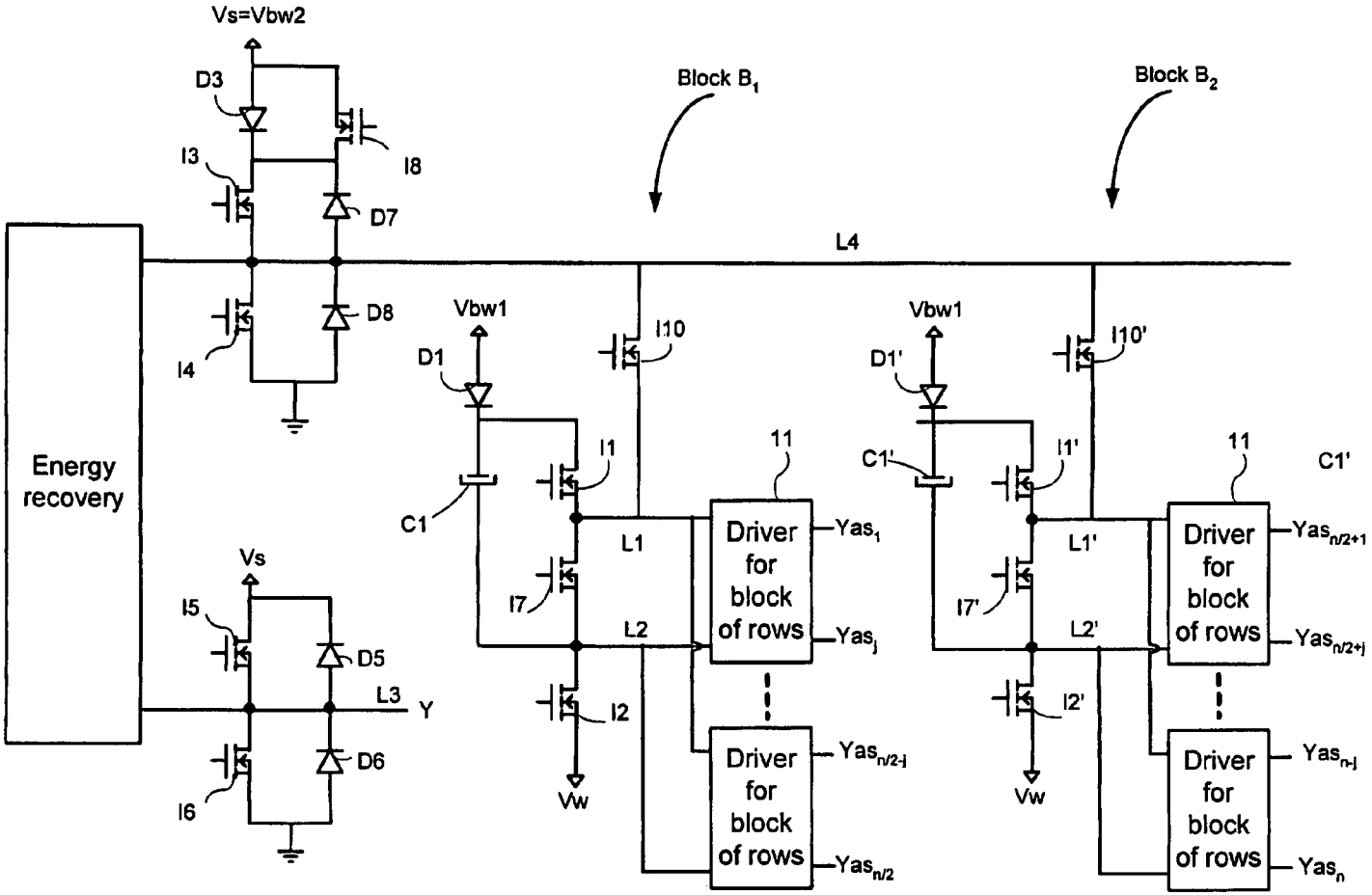
FIG. 10 shows the circuit diagram of a second row driver device according to the invention.

In order to reduce the complexity and cost of the device, the voltage Vbw2 is preferably taken to be equal to Vs as shown in FIG. 10. For this purpose, a switch I8 connected in parallel with the diode D3 is used to connect, via the diode D7, the terminal receiving the voltage Vs to the line L4 during the address phase of the PDP cells.

The switches I7 and I10 are open during the address phase of the rows of the block B1 and closed during the other phases, namely the address phase of the rows of the block B2, the sustain phase of the entirety of the PDP cells and the cell reset phase (not described here) preceding the address phase. Similarly, the switches I7' and I10' are open during the address phase of the rows of the block B2 and closed during the other phases, namely the address phase of the rows of the block B1 and the reset and sustain phases of the entirety of the PDP cells.

Figure 1:
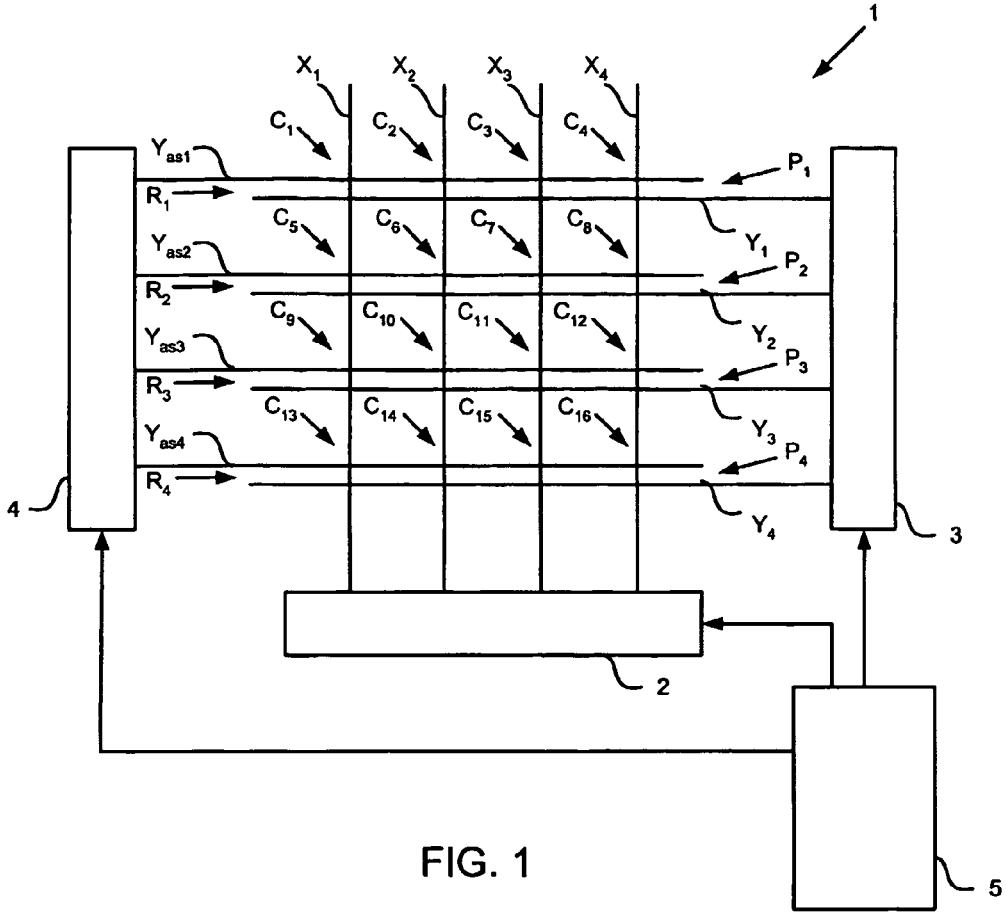
Figure 2:
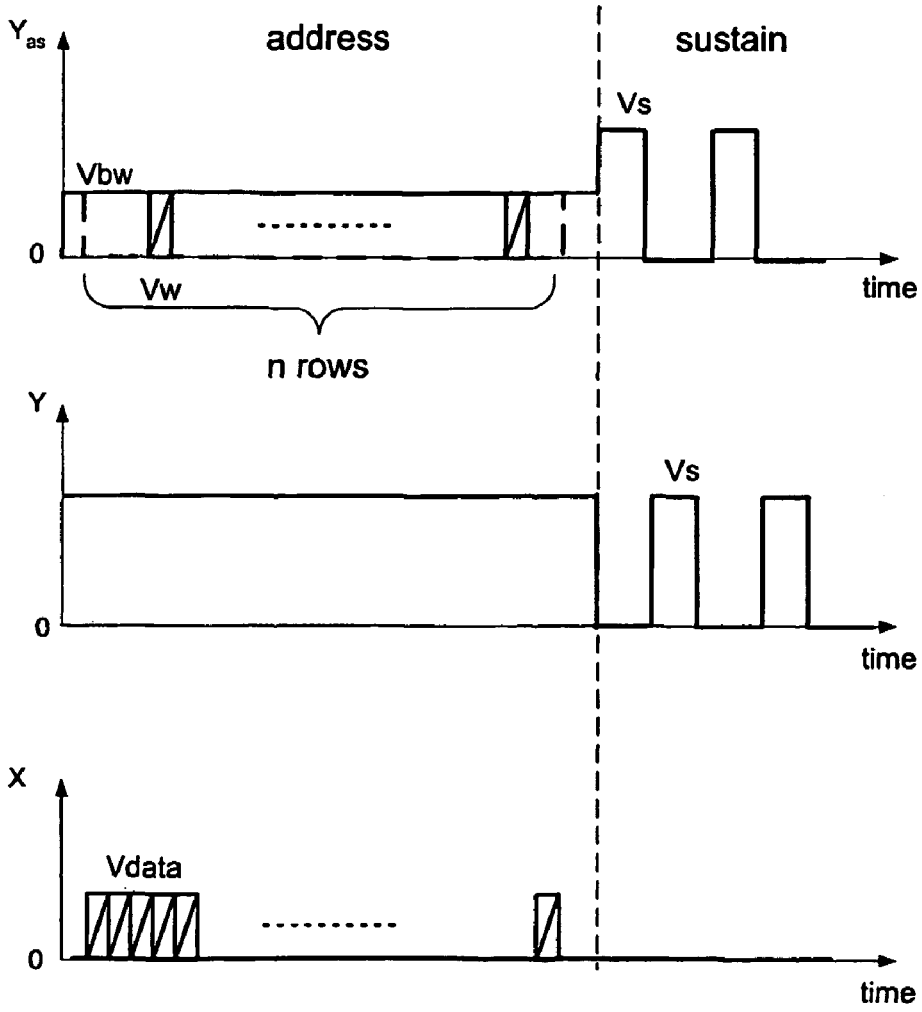
Figure 11:
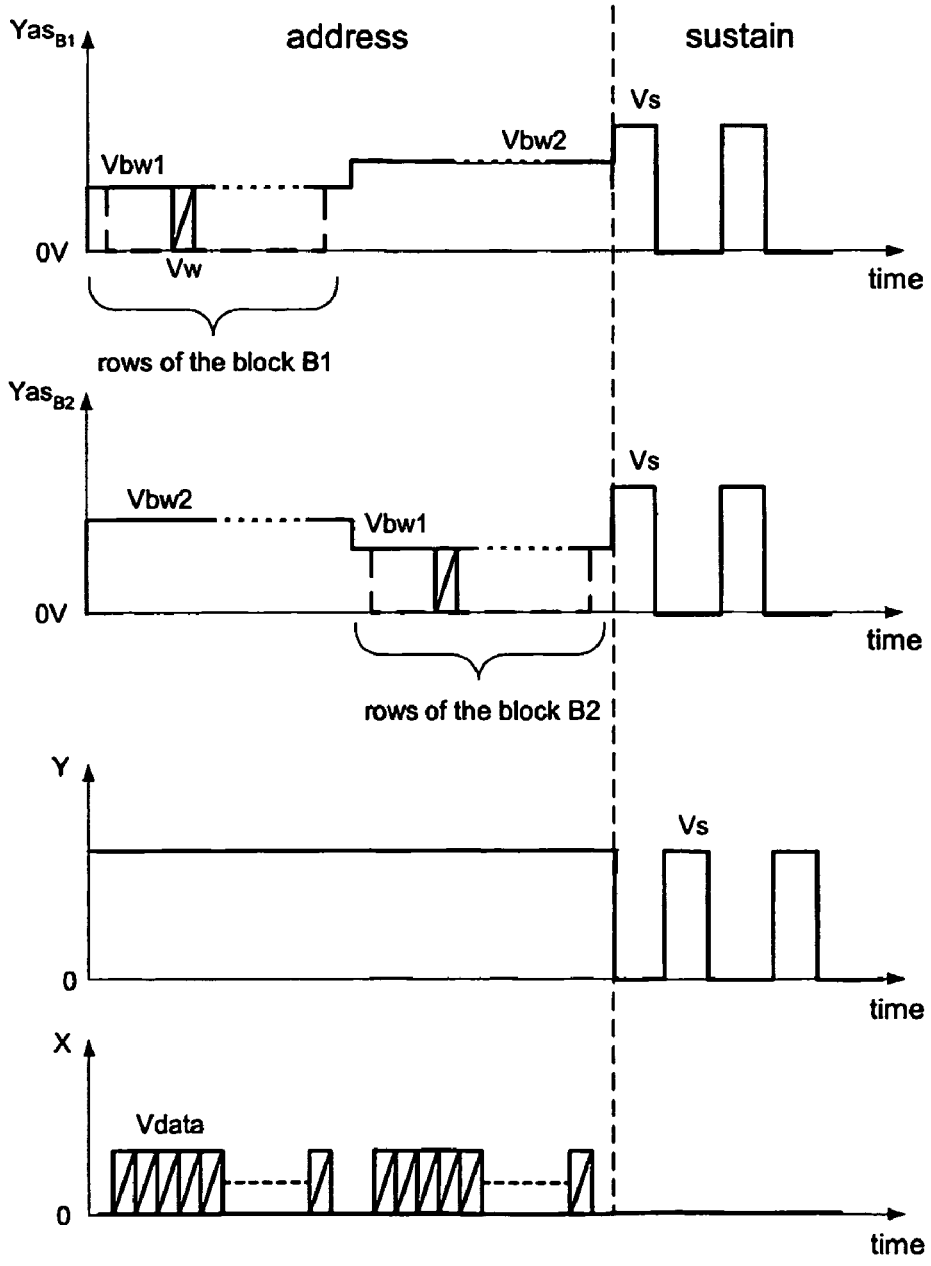
FIG. 11 shows the signals generated and applied to the electrodes of the display cells by the driver device in FIG. 10.

FIG. 11 illustrates the signals applied to the electrodes of the display cells during the address and sustain phases of the PDP cells with such a driver device. This figure is to be compared with FIG. 2. Only the signals applied to the electrodes Yas change relative to those in FIG. 2.

During the address phase of the rows of the block B1, each row is selectively addressed by the application of the voltage Vw to the corresponding electrode Yas. The rows of the block B1 not selected receive the voltage Vbw1 and the rows of the block B2 receive the voltage Vbw2.

During the address phase of the rows of the block B2, the addressed row of the block B2 receives the voltage Vw and the other rows of the block B2 receive the voltage Vbw1 The rows of the block B1 receive the voltage Vbw2.

Figure 12:
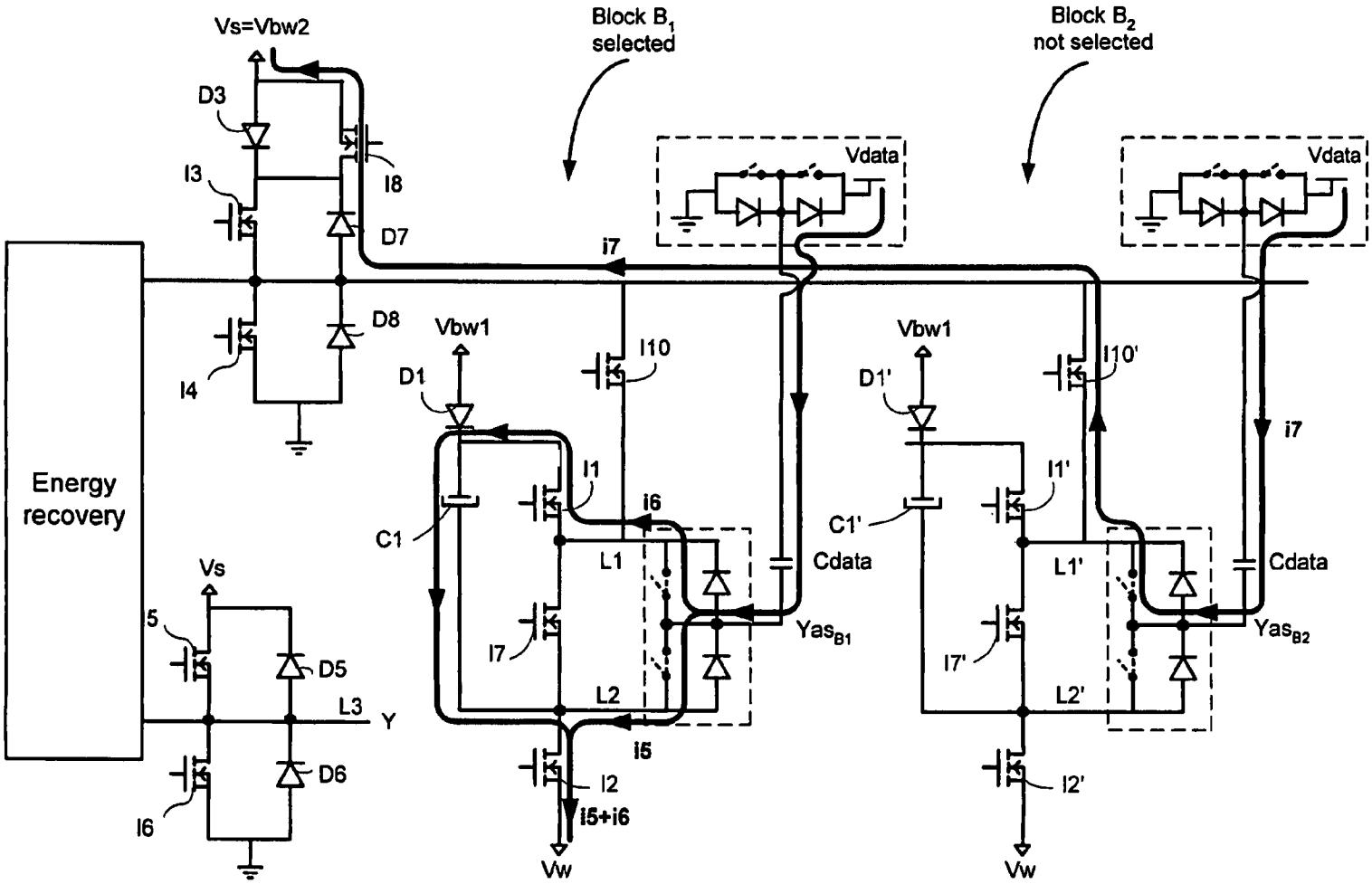
FIGS. 12 and 13 show the capacitive currents flowing in the driver device in FIG. 10 during the address phase of the PDP cells.
Figure 13:
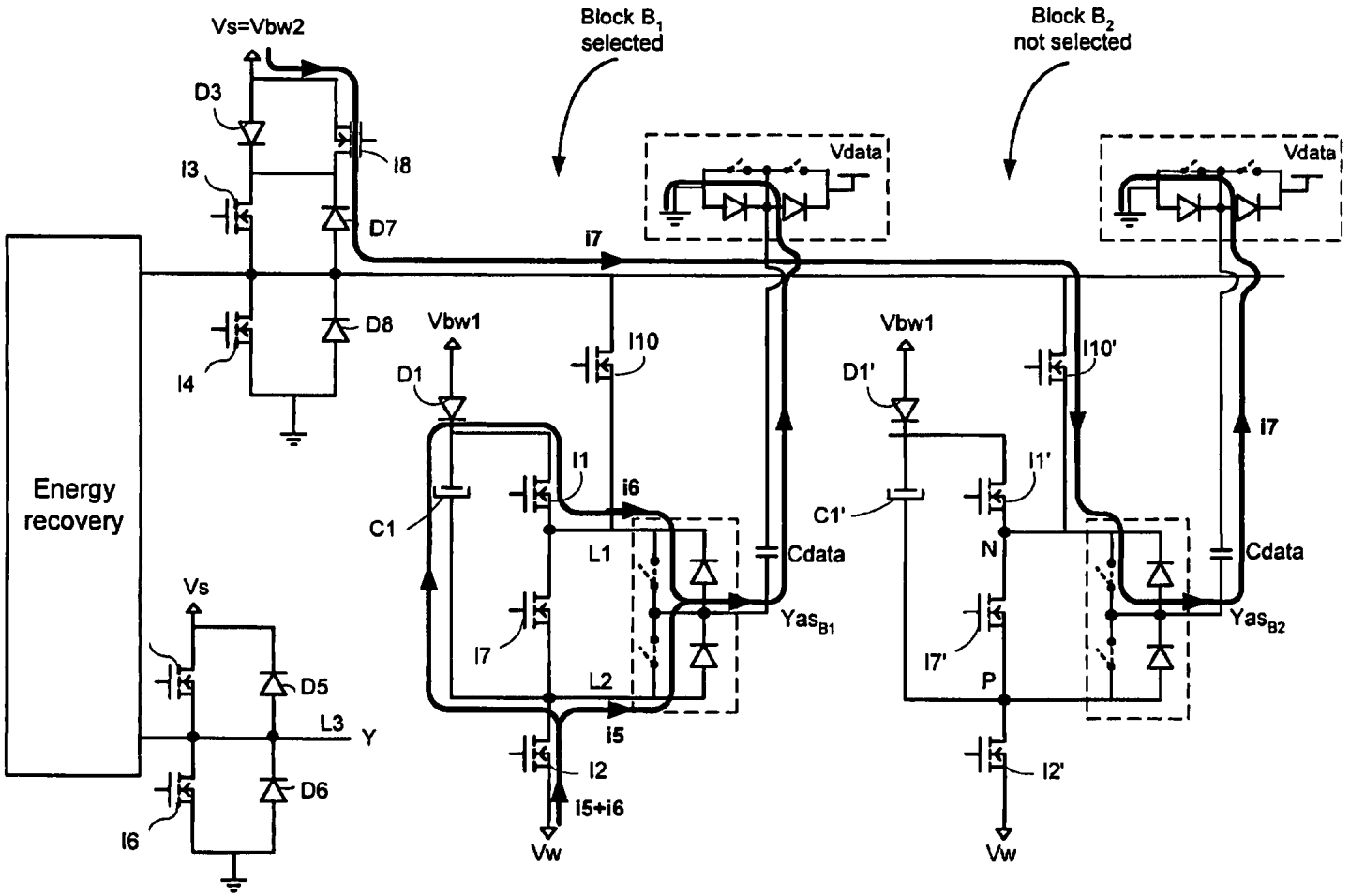

FIGS. 12 and 13 illustrate the capacitive currents flowing through the device in FIG. 10 during the address phase of a row of the block B1. In particular, FIG. 12 shows the currents flowing in the device during the falling edge (from Vbw to Vw) of the voltage applied to the electrodes Yas of the cells of the row selected in the block B1. FIG. 13 shows the currents flowing in the device during the rising edge (from Vw to Vbw) of the voltage applied to the selected row in the block B1.

In FIG. 12, the current i5 denotes the capacitive current flowing through the cells of the selected row of the block B1, the current i6 denotes the capacitive current flowing through the cells of the other rows of the block B1 and the current i7 denotes the capacitive current flowing through the cells of the block B2.

In FIG. 13, the currents i5, i6 and i7 flow through the device in the opposite direction.

Figure 14:
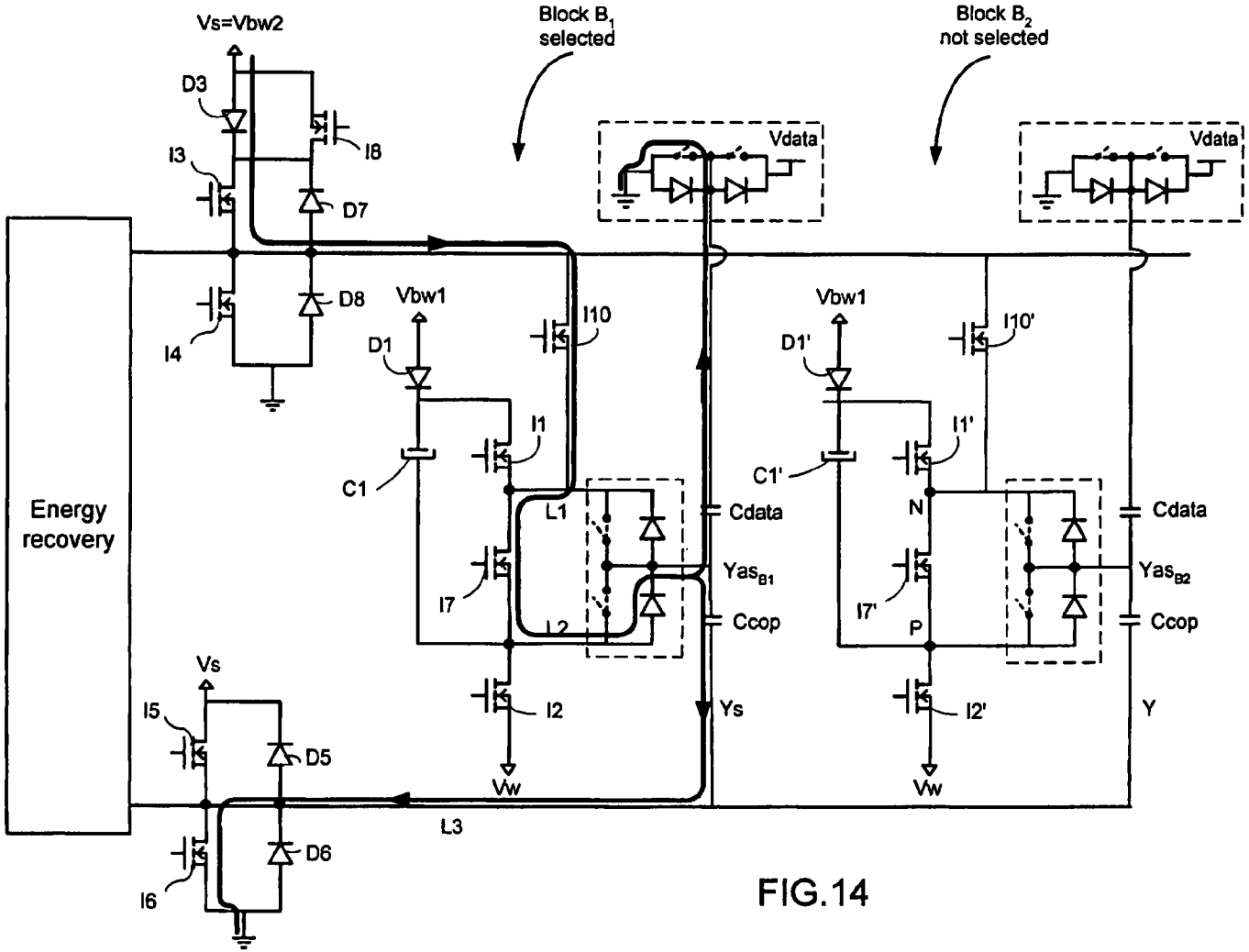
FIGS. 14 and 15 show the capacitive and light-emission currents flowing in the driver device in FIG. 10 during the sustain phase of the PDP cells.
Figure 15:
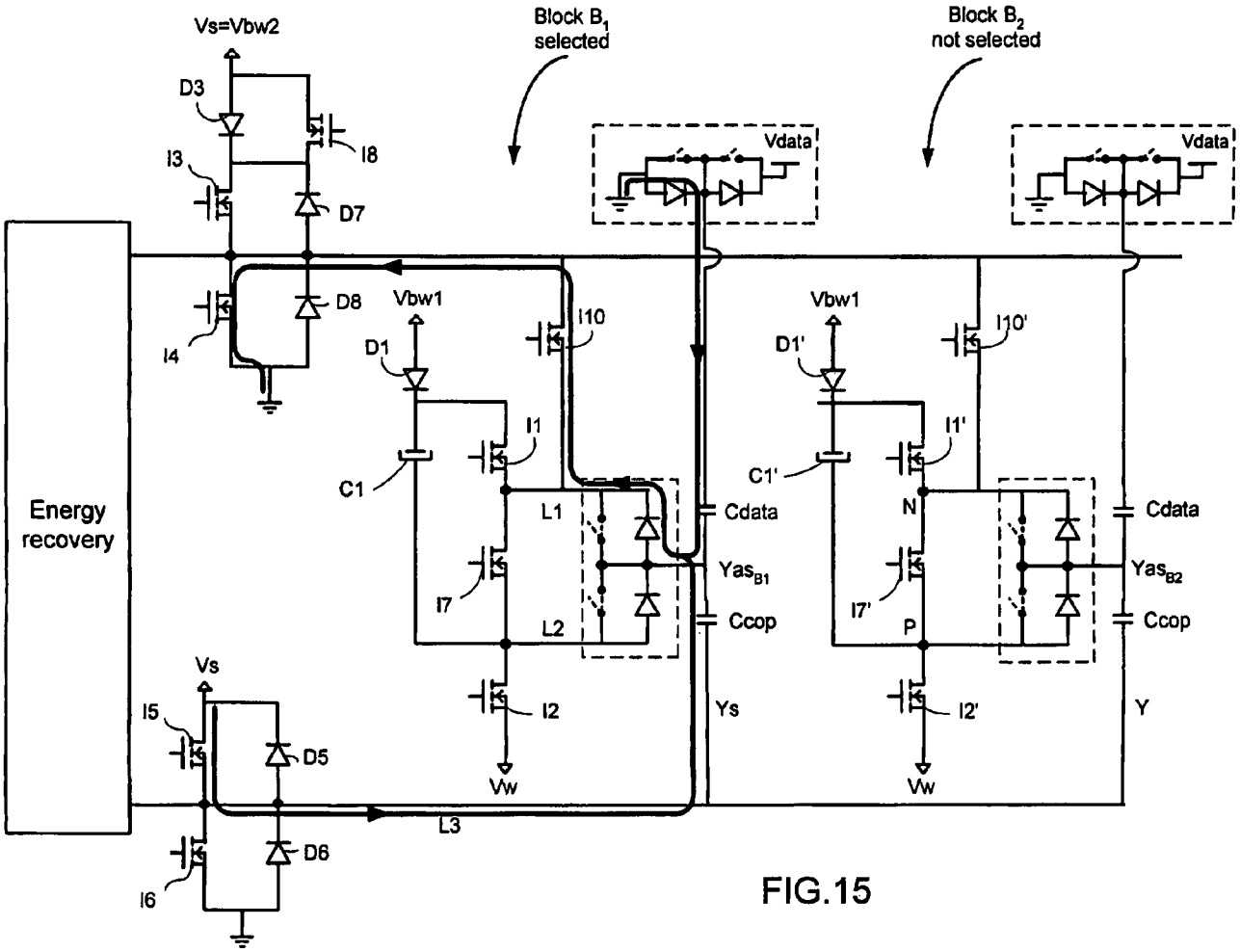

The currents flowing through the driver device in FIG. 10 during the cell sustain phase are shown in FIGS. 14 and 15. FIG. 14 shows the currents flowing through the device during the rising edge of the sustain signal on the cell electrode Yas and FIG. 15 shows the currents flowing through the device during the rising edge of the sustain signal on the cell electrode Y.

Figure 16:
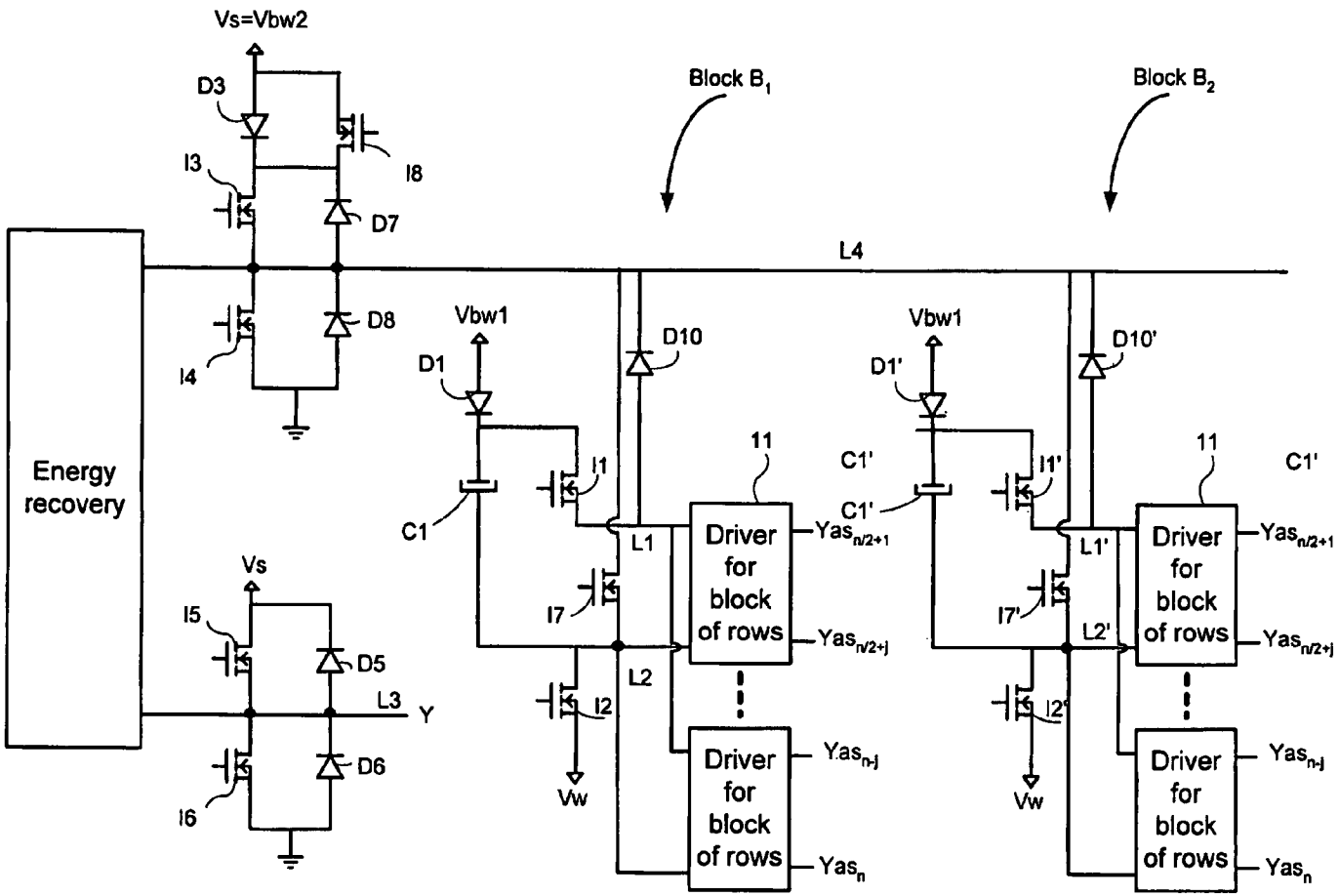
FIG. 16 shows a variant of the driver device in FIG. 10.

A variant embodiment, which reduces the cost of manufacture of the driver device, is proposed in FIG. 16. The switches I10 and I10' are replaced by diodes D10 and D10' and the switches I7 and I7' are connected between, on the one hand, the line L4, and on the other, the lines L2 and L2', respectively. The diodes D10 and D10' are oriented so as to not allow a current to flow in the direction of the connection line L1. This device operates in the same fashion as that in FIG. 10.

The invention claimed is:

1. Device for driving a plasma display panel having a plurality of cells arranged in rows and columns, the rows of cells being distributed in a plurality of blocks of lines, said device comprising row address means for selectively addressing the display cell rows within the blocks and creating, where required, in cooperation with means for selectively applying data voltages to the display columns, an electrical discharge inside the cell disposed at the intersection of the row and column selected during an address phase, and sustain means for sustaining the electrical discharges inside said cell during a sustain phase immediately following the address phase, wherein said row address means comprise separate row address means for each said block of rows for addressing successively the blocks of rows by applying a first voltage to the cells of the selected block and a second voltage to the cells of the other blocks, said second voltage being greater than the first voltage, said separate row address means comprising:

at least one row driver circuit connected between first and second connection lines and designed to apply, during an address phase specific to said block of rows, a potential of one of said first and second connection lines to a plurality of rows of the block, a capacitor, a first terminal of which being electrically connected to the first connection line via a first switch and a second terminal of which being coupled to the second connection line;

a second switch for selectively applying an address voltage to the second connection line during the address phase;

a first diode connected to the common point of the first switch and of the capacitor for supplying the first voltage to the capacitor during the address phase;

a second diode connected between the sustain means of the device and said first connection line for isolating said first connection line from the sustain means of said driver device during the row address phase of the relevant block, wherein the second diode is oriented so as not to allow a current to flow in the direction of the first connection line.

2. Device according to claim 1, wherein the separate row address means for each block of rows further comprises:

a eighth switch for applying said second voltage to said first connection line during the address phases specific to the other blocks.

3. Device according to claim 2, wherein said eighth switch is common to the address means of the blocks of rows.

4. Device according to claim 2, wherein said second voltage is equal to a high sustain voltage.

5. Device according to claim 2, wherein the sustain means comprise:

third and fourth switches for selectively applying a high sustain voltage and a low sustain voltage to said first connection line of the blocks when the switching means of said blocks is in an on state, fifth and sixth switches for selectively applying said high sustain voltage and said low sustain voltage to a second electrode of the cells of the plurality of rows selected by said row driver circuit, said third and sixth switches on the one hand, and said fourth and fifth transistors on the other, being controlled in an identical manner.

6. Device according to claim 5, wherein the sustain means additionally comprise:

a third diode connected in series with said third switch and oriented so as to allow a current to flow into the first connection line of the blocks when the switching means of said blocks is in the on state, and third and fourth diodes connected in parallel with the third and fourth switches, respectively, and fifth and sixth diodes connected in parallel with the fifth and sixth switches, respectively.

7. Device according to claim 5, wherein the sustain means additionally comprise a seventh switch inserted between the first and second connection lines of each block, which switch is open during the row address phase of the relevant block and closed during the sustain phase.

8. Device according to claim 3, wherein said eighth switch is connected in parallel with a third diode.

9. Plasma display panel wherein it comprises a driver device according to claim 1.

* * * * *